US010569936B1

(12) United States Patent
Small

(10) Patent No.: US 10,569,936 B1
(45) Date of Patent: Feb. 25, 2020

(54) MULTI-COMPARTMENTAL CONTAINER

(71) Applicant: Ray Small, Windsor, CT (US)

(72) Inventor: Ray Small, Windsor, CT (US)

( * ) Notice: Subject to any disclaimer, the term of this patent is extended or adjusted under 35 U.S.C. 154(b) by 3 days.

(21) Appl. No.: 16/025,540

(22) Filed: Jul. 2, 2018

(51) Int. Cl.

| | |
|---|---|
| ***B65D 35/00*** | (2006.01) |
| ***A45D 34/00*** | (2006.01) |
| ***B65D 1/32*** | (2006.01) |
| ***B65D 35/24*** | (2006.01) |
| ***B65D 35/22*** | (2006.01) |
| *B65D 35/36* | (2006.01) |
| *A45D 19/02* | (2006.01) |
| *A45D 34/04* | (2006.01) |
| *A46B 11/00* | (2006.01) |

(52) U.S. Cl.
CPC ..... *B65D 35/22* (2013.01); *A45D 34/00* (2013.01); *B65D 1/32* (2013.01); *B65D 35/242* (2013.01); *A45D 19/02* (2013.01); *A45D 34/042* (2013.01); *A45D 2200/058* (2013.01); *A46B 11/0041* (2013.01); *B65D 35/36* (2013.01)

(58) Field of Classification Search
CPC ..... B65D 35/242; B65D 35/22; B65D 35/36; B65D 25/08; B65D 81/3255; B65D 2217/00; B65D 2217/02; B65D 2217/04; A46B 11/00; A46B 11/0041; A46B 11/0044; A46B 11/0048; A45D 19/02; A45D 34/00; A45D 34/042; A45D 34/048
See application file for complete search history.

(56) References Cited

U.S. PATENT DOCUMENTS

| | | | | | |
|---|---|---|---|---|---|
| 1,535,529 | A * | 4/1925 | Hopkins | B65D 35/22 | 222/94 |
| 2,589,743 | A * | 3/1952 | Snaith | B65D 35/22 | 222/94 |
| 2,819,723 | A * | 1/1958 | Meyer | A45D 24/22 | 132/116 |
| 2,876,935 | A * | 3/1959 | Lindberg | F41H 9/10 | 239/304 |
| 3,178,157 | A * | 4/1965 | Cole, III | B01F 15/0238 | 366/162.1 |
| 3,197,071 | A * | 7/1965 | Kuster | B65D 81/325 | 222/94 |
| 3,335,912 | A * | 8/1967 | Reeves, Jr. | B65D 35/22 | 222/94 |
| 3,608,782 | A * | 9/1971 | Sathicq | A45D 19/02 | 222/94 |
| 3,843,548 | A * | 10/1974 | James | A61K 9/12 | 252/187.26 |
| 4,528,180 | A * | 7/1985 | Schaeffer | A61K 8/042 | 222/192 |

(Continued)

*Primary Examiner* — Patrick M. Buechner
(74) *Attorney, Agent, or Firm* — Sanchelima & Associates, P.A.; Christian Sanchelima; Jesus Sanchelima

(57) ABSTRACT

A multi-compartmental container for storage and easy mixing of two or more materials, e.g., pastes, is disclosed. The container has a container portion that includes two or more compartments containing materials that need to be mixed. The container further includes an outlet nozzle provided at an operative top end of the container. The compartments of the container portion are in fluid communication with each other so that the contents of the compartments can inter-mix with each other, when the container is shaken manually, thereby providing a final product that is to be applied to a body part of a user.

6 Claims, 6 Drawing Sheets

(56) References Cited

U.S. PATENT DOCUMENTS

| | | | | | |
|---|---|---|---|---|---|
| 4,801,008 | A * | 1/1989 | Rich | B05C 17/00516 | 206/219 |
| 4,850,730 | A * | 7/1989 | Jimenez | A46B 11/0041 | 401/184 |
| 5,066,157 | A * | 11/1991 | Liff | A46B 11/0072 | 401/270 |
| 5,154,321 | A * | 10/1992 | Shomer | B01F 5/0683 | 206/219 |
| 5,169,030 | A * | 12/1992 | Lewin | B65D 35/22 | 222/107 |
| 5,385,270 | A * | 1/1995 | Cataneo | B05B 11/3081 | 222/134 |
| 5,848,730 | A * | 12/1998 | Kawase | A45D 19/02 | 222/94 |
| 8,083,056 | B1 * | 12/2011 | Wu | B65D 25/08 | 206/221 |
| 9,439,490 | B2 * | 9/2016 | DeGeorge | A45D 7/04 | |
| 2007/0187429 | A1 * | 8/2007 | Farahmand | B65D 35/22 | 222/94 |
| 2011/0031274 | A1 * | 2/2011 | Shih | B65D 1/06 | 222/92 |
| 2013/0334250 | A1 * | 12/2013 | Albaum | B65D 81/3272 | 222/129 |

* cited by examiner

MULTI-COMPARTMENTAL CONTAINER

BACKGROUND OF THE INVENTION

1. Field of the Invention

The present disclosure relates to a container. More particularly, the present disclosure relates to a container for dispensing multiple items at a time.

2. Description of the Related Art

Typically beauty products such as hair dyes, facial kits, and the like involve the mixing of two or more products for preparing the final product for application on the required part of the body. These products are typically packed in different tubes or containers. This increases the size and material required for packaging these beauty products, which is undesired. Hence, there is need for an alternate packaging that overcomes the aforementioned drawback.

Several designs for containers for storing two or more products have been designed in the past. None of them, however, have been designed to have a convenient to use and easy to manufacture configuration, which facilitates easy mixing of the contents of the containers.

Applicant believes that a related reference corresponds to US Patent Publication no. 20070187429 filed by Bardia Farahmand for a dual opening tubular dispenser. The Farahmand reference discloses a single or dual compartment dispenser comprising a tubular body and capped openings on the opposite ends of the tube. However, the dispenser disclosed in the Farahmand reference, allows dispensation of the products from two separate compartments/tubes without actually effecting the mixing of those products.

Another related application is US Patent Publication no. 20110031274 filed by Shan-Le Shih for a toothpaste container having multiple outlets and air vents. The Shan reference discloses a toothpaste container having multiple outlets, wherein a separate outlet can be allotted to each member of a family for preventing the cross infection of oral diseases among the family members. However, the Shan reference fails to disclose a container for storing two or more products for facilitating their easy mixing.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a multi-compartmental container for storing two or more products therein.

It is still another object of the present invention to provide a multi-compartmental container for storing two or more products, which can further facilitate easy mixing of the products stored within the compartments.

It is yet another object of the present invention to provide a multi-compartmental container that is convenient to use and easy to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
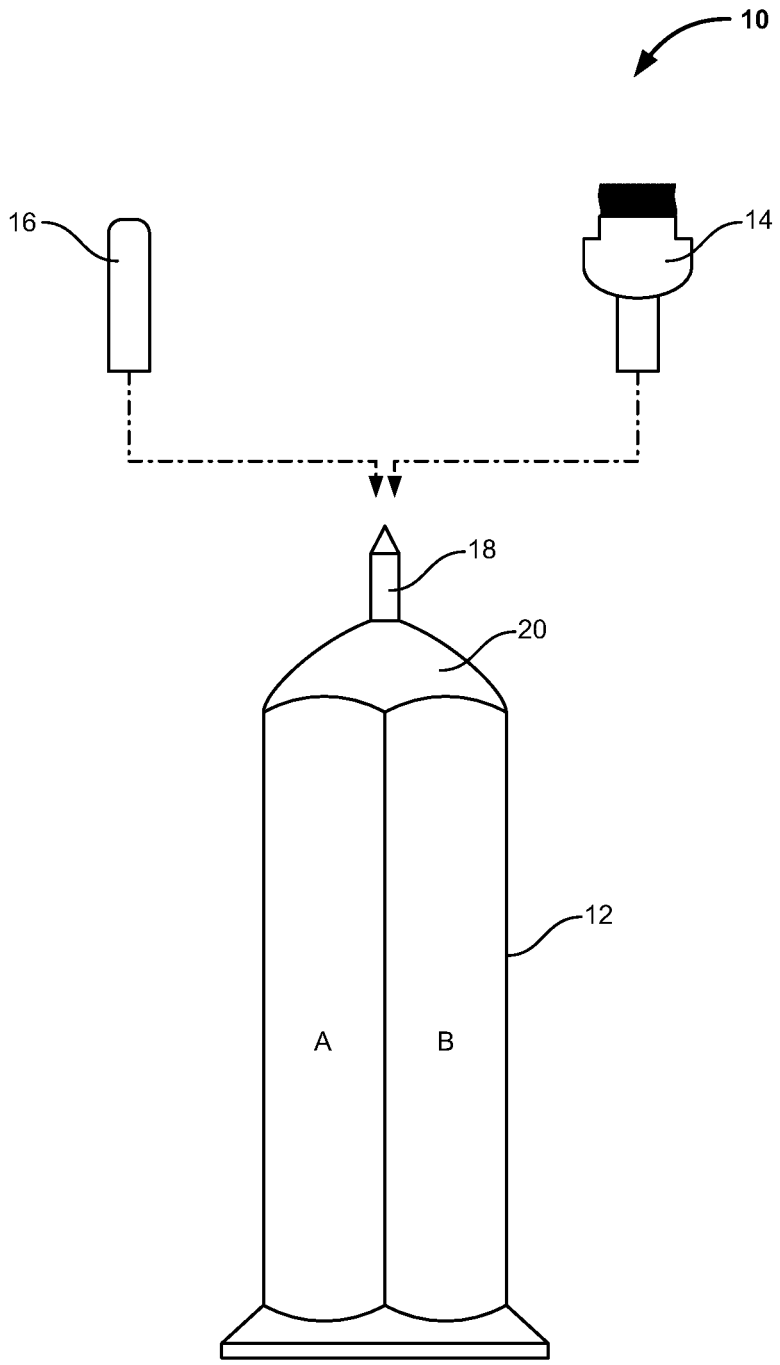
FIG. 1 represents a schematic view a multi-compartmental container 10, in accordance with one embodiment of the present invention, which comprises a container portion 12, wherein the container portion comprises the compartments A and B. The container further comprises a brush attachment 14 and a cover 16.
Figure 2A:
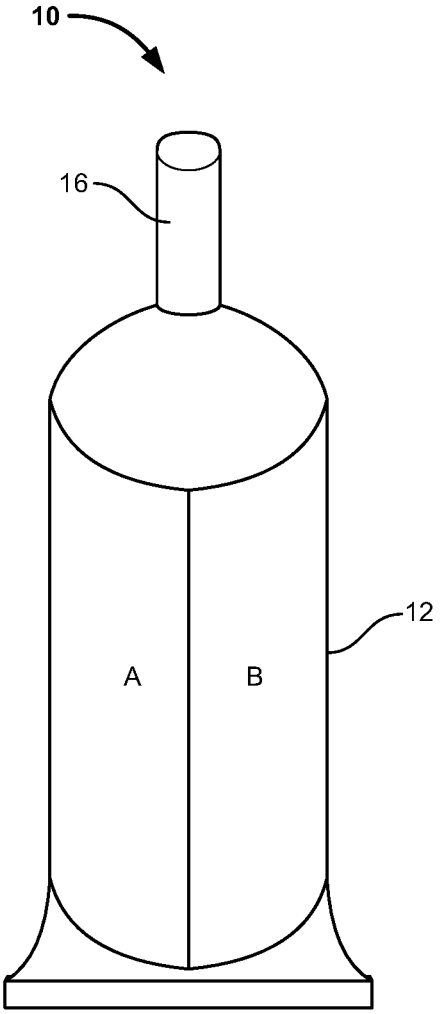
FIGS. 2A and 2B represent schematic views of the container 10, illustrated in FIG. 1, wherein an outlet nozzle 18 is fitted with the cover 16 and the brush attachment 14, respectively.
Figure 2B:
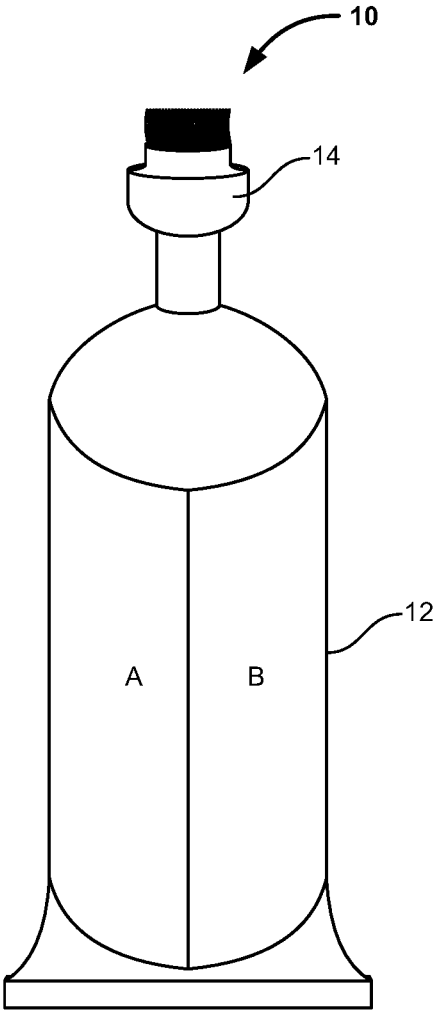

Referring to FIG. 1 through FIG. 2B, where the present invention is generally referred to with numeral 10, it can be observed that the multi-compartmental container for storing two or more products 10 (interchangeably referred to as container 10), in accordance with one embodiment, comprises a container portion 12, wherein the container portion comprises the compartments A and B. The container 10 further comprises a brush attachment 14 and a cover 16.

In accordance with one embodiment, the container portion 12 comprises two compartments A and B for storing two products. However, the number of compartments is not limited to two, and the container portion 12 can include any number of compartments, per the application requirements.

The embodiment illustrated in FIG. 1 includes the cover 16 and the brush attachment 14. This embodiment of the container can be used for storing a hair dye. More specifically, hair dyes require the mixing of two or more creams to create the final product for application on the hair. Using the container 10, in accordance with the present invention, a user can mix the components stored in the compartments of the container portion 12 by shaking the container 10. On shaking the container, the components stored in the compartments of the container portion form the final product ready for application on the required body part, which in the present scenario, are the hair of the user. The brush attachment 14 allows the user to evenly apply the hair dye.

Figure 3:
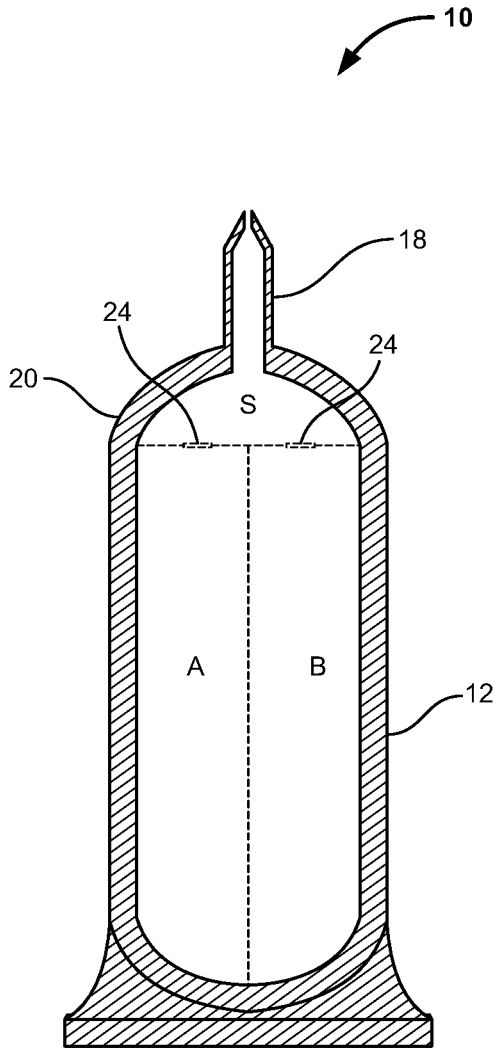
FIG. 3 represents a sectional view of the container 10, in accordance with one embodiment of the present invention.

The construction of the different embodiments of the container 10 is hereinafter described with reference to FIG. 3 through FIG. 6. Referring to FIG. 3, an embodiment of the container 10 is illustrated wherein viscous pastes can be stored in the compartments of the container portion 12 which can otherwise not be mixed by just shaking the container 10. The container 10 comprises an outlet nozzle 18 provided at an operative top end thereof. From the outlet nozzle 18 extends a flange portion 20 that provides the enclosing connection between the compartments A and B of the container portion 12 and the outlet nozzle 18.

In accordance with the present embodiment, the pastes that are stored in the compartments A and B are highly viscous and cannot be mixed by simply shaking the container 10. Therefore, the pastes stored in the compartments A and B are dispensed out from the nozzle 18 by pressing the container 10 at the bottom portion. The pastes enter the space 'S' formed between the operative top end of the compartments A and B and the outlet nozzle 18 via the apertures 24 provided on the operative top ends of the compartments A and B. The pastes, after entering the space S, form a preliminary mixture and dispensed out of the nozzle 18 when the bottom of the container 10 is pressed further. This preliminary mixture is not thoroughly mixed and is to be received on a receiving means such as a dish for manual and thorough mixing with a brush or any other means.

In the embodiment illustrated in FIG. 3, the mixing within the compartments A and B does not occur, however, a packaging like the one illustrated in FIG. 3 saves the packaging costs otherwise incurred in packaging different products in different containers.

Figure 4:
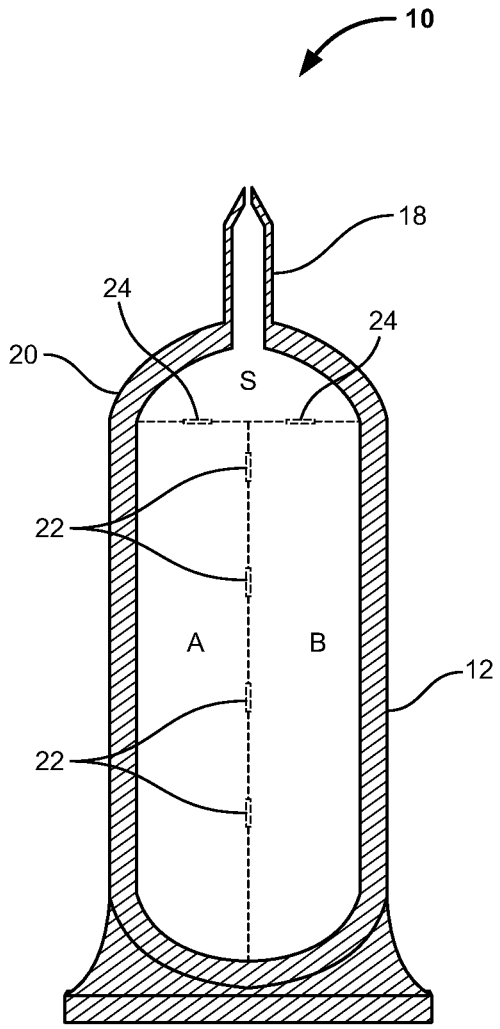
FIG. 4 represents a sectional view of the container 10, in accordance with another embodiment of the present invention.

Referring to FIG. 4, the construction of the container 10 has a similar construction to the embodiment illustrated in FIG. 3, with the exception that the container 10 illustrated in FIG. 4 is designed for the storage of easily mixable materials therewithin. As seen in FIG. 4, the compartments A and B are in fluid communication with each other via a plurality of apertures 22. More specifically, the materials stored in compartments A and B can be easily mixed by manually shaking the container 10. Once the materials are mixed thoroughly, the final product for application of the body part, e.g., a hair dye is prepared within the compartments A and B, which can apply onto the hair using the brush attachment 14 mounted on the nozzle 18.

In accordance with one embodiment of the present invention, the nozzle 18 of the container 10, as illustrated in FIG. 4, has a point tip like configuration. Such a configuration of the nozzle 18 facilitates precise application of the final mixed product from the container 10 onto the desired body part. In one exemplary application, such a configuration of the container 10 with the nozzle 18 having a point tip like configuration can be used in application of henna based temporary tattoos. In accordance with another exemplary application, such a container 10 can be used to color or dye moustaches and other areas that are hard to get to, thereby making it much easier to color these areas without making any mess or over coloring.

Figure 5:
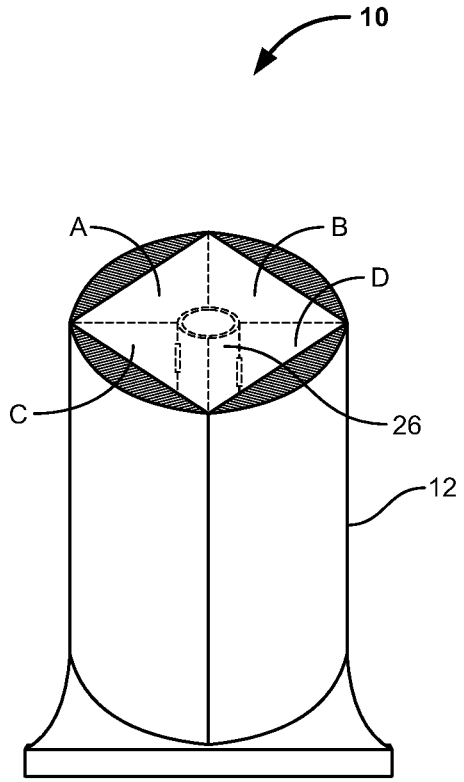
FIG. 5 represents a partly cut view of the container 10, in accordance with still another embodiment of the present invention.

Referring to FIG. 5, a partly cut view of the container portion 12 is illustrated of an embodiment of the container 10 having four compartments, viz., A, B, C, and D. The container 10, as illustrated in FIG. 5, has a central tube 26. The central tube 26 can be a perforated tube in accordance with one embodiment. The central tube 26 is in fluid communication with all the four compartments A, B, C, and D. The perforations on the central tube 26 allow the materials from all the four compartments A, B, C, and D to enter and mix within the central tube 26. In one embodiment, the central tube 26, can directly connect with the outlet nozzle 18, for allowing the final mixed product to be dispensed from the nozzle 18.

Figure 6:
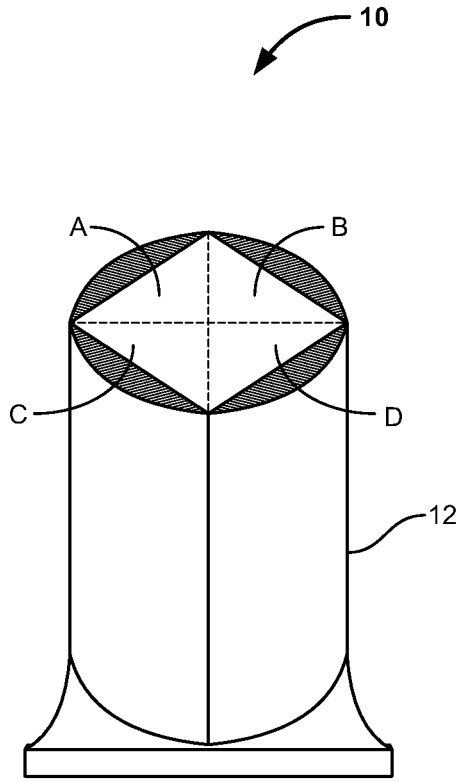
FIG. 6 represents a partly cut view of the container 10, in accordance with yet another embodiment of the present invention.

Referring to FIG. 6, a partly cut view of the container portion 12 is illustrated in accordance with yet another embodiment of the container 10 having four compartments, viz., A, B, C, and D, and specifically designed for materials that are not easily mixable. Similar to the embodiment described with reference to FIG. 3, the pastes stored in the compartments A, B, C, and D are first lightly mixed in the container 10 in the space S, before being received onto a receiving means such as a dish to be mixed manually and thoroughly by means of a brush or any other means.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multi compartmental container for containing two or more products, the container comprising:

a. a plurality of compartments defined within the container, wherein said plurality of compartments are in fluid communication with each other;

b. an outlet nozzle provided on an operative top end of the container;

c. a space defined between the operative top end of the plurality of compartments and the operative bottom end of the nozzle; and d. wherein the contents of the plurality of compartments are mixed when the container is shaken owing to the fluid communication between the compartments as well as the fluid communication of the plurality of compartments with the space, thereby forming the final mixed product ready for use directly out of the container.

2. The container as claimed in claim 1, wherein a brush attachment is connectable to the outlet nozzle.

3. The container as claimed in claim 1, wherein the outlet nozzle has a point tip like configuration for facilitating precise application of the final mixed product from the container onto a desired body part.

4. A multi compartmental container for containing two or more products, the container comprising:

a. a plurality of compartments defined within the container, wherein said plurality of compartments are fluidly coupled with each other;

b. a central tube having at least one aperture configured thereon placed within the container in fluid communication with the plurality of compartments;

c. an outlet nozzle provided on an operative top end of the container;

d. a space defined between the operative top end of the plurality of compartments and the operative bottom end of the nozzle; and e. wherein the contents of the plurality of compartments are mixed when the container is shaken owing to the fluid communication between the central tube and the plurality of compartments as well as the fluid communication of the plurality of compartments with the space, thereby forming the final mixed product ready for use directly out of the container.

5. The container as claimed in claim 4, wherein the central tube has a perforated configuration.

6. The container as claimed in claim 4, the central tube extends along the length of the container and operably connects with the outlet.

* * * * *